US006499830B1

(12) United States Patent
Kumon et al.

(10) Patent No.: US 6,499,830 B1
(45) Date of Patent: Dec. 31, 2002

(54) IMAGE FORMING APPARATUS AND IMAGE FORMING HEAD

(75) Inventors: Akira Kumon, Osaka (JP); Akira Fukano, Nara (JP); Yoshitaka Kitaoka, Osaka (JP); Akira Ryoji, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/831,700

(22) PCT Filed: Nov. 10, 1999

(86) PCT No.: PCT/JP99/06239

§ 371 (c)(1),
(2), (4) Date: May 11, 2001

(87) PCT Pub. No.: WO00/29220

PCT Pub. Date: May 25, 2000

(30) Foreign Application Priority Data

Nov. 13, 1998 (JP) ..... 10-323097

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

FOREIGN PATENT DOCUMENTS

| | | |
|---|---|---|
| EP | 710898 | 5/1996 |
| EP | 754557 | 1/1997 |
| EP | 860753 | 8/1998 |
| JP | 58-104769 | 6/1983 |
| JP | 58-104771 | 6/1983 |
| JP | 58-122882 | 7/1983 |
| JP | 08-324017 | 12/1996 |
| JP | 10-235923 | 9/1998 |
| JP | 11-91153 | 4/1999 |

*Primary Examiner*—Raquel Yvette Gordon
(74) *Attorney, Agent, or Firm*—Harness, Dickey & Pierce, P.L.C.

(57) ABSTRACT

An image forming apparatus for use in a printer for computers and the like includes an image forming head (7) between a developing sleeve (2) and an opposing electrode. (6). Control electrodes (19) are provided around respective openings (16) of the head (7), so that the openings (16) are electrostatically opened and closed by controlling a voltage applied to the respective control electrodes (19). In order to prevent the openings (16) of the head (7) from being clogged with toner (5), the percentage of the area of the opening (16) to the sum of the area of the extent of the control electrode (19) around the opening (16) and the area of the opening (16) is set to 8% or more.

14 Claims, 10 Drawing Sheets

IMAGE FORMING APPARATUS AND IMAGE FORMING HEAD

TECHNICAL FIELD

The present invention relates to an image forming apparatus and an image forming head for use in, e.g., a printer for computers, facsimiles, copying machines and the like, for driving charged particles from a charged-particle supporting element onto an image receiving medium according to an image signal.

BACKGROUND ART

In this type of image forming apparatuses, an insulating member having a plurality of openings for passing charged particles therethrough is provided between a supporting element for supporting and carrying the charged particles and an opposing electrode, an image receiving medium is provided between the opposing electrode and the insulating member, and a control electrode is provided around each opening. For image formation, a potential difference is provided in advance between the supporting element and the opposing electrode so as to form an electrostatic field for transferring the charged particles from the supporting element toward the opposing electrode. A voltage applied to the control electrodes is controlled to electrostatically open and close the openings, whereby the charged particles are separated from the supporting element onto the image receiving medium through the openings, according to an image signal.

Japanese Laid-Open Publication No. 58-122882 describes that, upon detecting absence of an image receiving medium, spark discharge is generated between control electrodes and an opposing electrode or the like by application of a high voltage to the control electrodes, so as to blow off the toner stuck in openings.

Japanese Laid-Open Publication No. 58-104769 describes that, when image formation is not conducted, an electric field between control electrodes and an image receiving medium is increased so as to remove the toner stagnant in openings toward the image receiving medium.

Japanese Laid-Open Publication No. 58-104771 describes that, during image recording, an electric field between a supporting element and an image receiving medium as well as an electric field in openings are produced in the traveling direction of charged particles toward the image receiving medium, and during non-recording, respective electric fields between the supporting element and a control member and between the control member and the image receiving medium are produced in the opposite direction to that during recording, whereby clogging of the openings with the toner is prevented.

However, in the aforementioned method for removing the charged particles in the openings by spark discharge, an insulating member having the openings may be damaged by the spark discharge if it is formed from a synthetic resin. Moreover, an additional power supply is required to generate the spark discharge, and the charged particles may possibly be fusion-bonded on the insulating member due to heating by the spark discharge.

Moreover, in the method for removing the charged particles in the openings when no image is formed (during non-recording), the charged particles stuck in the openings cannot be removed, if any, during the image formation, i.e., while the charged particles are being sequentially attached to, e.g., a sheet of recording paper according to an image signal. Moreover, the aforementioned methods all require a special voltage-application mode to remove the charged particles in the openings, and also require a special power supply, thereby often increasing the costs.

In other words, it is an object of the present invention to prevent clogging of the openings without voltage control of the control electrodes.

DISCLOSURE OF THE INVENTION

The present invention solves the aforementioned problems by applying ideas to the area of the opening.

More specifically, according to the present invention, an image forming apparatus for forming an image by attaching charged particles to an image receiving medium includes:

- a charging means for applying charges to particles for forming an image;
- a supporting element for supporting and carrying the charged particles having the charges applied thereto by the charging means;
- an opposing electrode provided at a position facing a position on the supporting element to which the charged particles are carried;
- an insulating member provided between the supporting element and the opposing electrode and having a plurality of openings for passing the charged particles therethrough;
- a control electrode provided around each opening of the insulating member;
- a transfer-electrostatic-field forming means for providing a potential difference so as to form between the supporting element and the opposing electrode a transfer electrostatic field for transferring the charged particles on the supporting element toward the opposing electrode; and
- a voltage control means for applying a voltage to the control electrodes around the respective openings according to an image signal so as to control passage of the charged particles through the respective openings that is caused by the transfer electrostatic field, wherein
- a percentage of an area of the opening to a sum of an area of an extent of the control electrode around the opening and the area of the opening is 8% or more.

The present invention will be specifically described. The inventor arranged ring-shaped control electrodes surrounding respective circular openings, and applied a pulsed driving voltage to the control electrodes so that the control electrodes each have, at a respective opening position, an intermediate potential of the voltage difference between an opposing electrode and a developing sleeve (supporting element), thereby causing charged particles on the developing sleeve to be intermittently driven onto an image receiving medium through the openings. The inventor then observed the resultant driving trace on the developing sleeve (the trace where the charged particles have gone away). This driving trace did not have a circular shape corresponding to the shape of the opening, but a large circular shape corresponding to the outer shape of the control electrode. In other words, dots are not only formed from the charged particles present on a location of the developing sleeve that corresponds to the opening, but the charged particles present on a location of the developing sleeve that corresponds to the control electrode also contributes to the dot formation. This means that not only the charged particles present on the location of the developing sleeve that corresponds to the opening, but also the charged particles present on the location of the developing sleeve that corresponds to the control electrode are separated away from the developing sleeve toward the opening and pass therethrough, in response to application of the driving voltage to the control electrode.

The reason why the charged particles present on the location of the developing sleeve that corresponds to the control electrode move toward the opening is as follows: in response to application of the driving voltage, the charged particles present in the space right above the opening (the space between the location of the developing sleeve corresponding to the opening and the opening location of the insulating member) are discharged through the opening, whereby the charged-particle concentration in the space is reduced. However, as can be seen from the equipotential lines shown in FIG. 4, an electrostatic field surrounding the control electrode 19 is produced with its potential progressively increased toward the control electrode 19. Accordingly, with the reduction in charged-particle concentration right above the opening 16, the electrostatic field moves the charged particles from a position around the space right above the opening 16 toward the opening 16.

Thus, not only the charged particles on the location of the developing sleeve that corresponds to the opening 16, but also the charged particles on the location of the developing sleeve that corresponds to the control electrode 19 are going to pass through the opening 16. Therefore, when the area of the control electrode 19 is too large as compared to the area of the opening 16, not all of these charged particles smoothly pass through the opening 16, resulting in clogging of the opening 16.

Then, paying attention to the area of the opening 16 and the area of the extent of the control electrode 19 around the opening, the inventor defined that the percentage of the opening area to the sum of the area of the extent of the control electrode around the opening and the opening area is set to 8% or more. Herein, the area of the extent of the control electrode around the opening is the projected area of the control electrode onto the plane orthogonal to the shortest line connecting the supporting element and the opposing electrode through the opening, or the projected area of the control electrode onto the supporting element.

Since the aforementioned percentage is 8% or more in the present invention, the opening can be prevented from being clogged with the charged particles. This will become apparent from the embodiments described below.

Moreover, according to the present invention, an image forming apparatus for forming an image by attaching charged particles to an image receiving medium includes:

a charging means for applying charges to particles for forming an image;

a supporting element for supporting and carrying the charged particles having the charges applied thereto by the charging means;

an opposing electrode provided at a position facing a position on the supporting element to which the charged particles are carried;

an insulating member provided between the supporting element and the opposing electrode and having a plurality of openings for passing the charged particles therethrough;

a control electrode provided around each opening of the insulating member;

a transfer-electrostatic-field forming means for providing a potential difference so as to form between the supporting element and the opposing electrode a transfer electrostatic field for transferring the charged particles on the supporting element toward the opposing electrode; and a voltage control means for applying a voltage to the control electrodes around the respective openings according to an image signal so as to control passage of the charged particles through the respective openings that is caused by the transfer electrostatic field, wherein a percentage of an area of the opening to an area of a portion of the supporting element that is affected by the control electrode so as to drive the charged particles into the opening in response to application of the voltage from the voltage control means to the control electrode is 8% or more.

More specifically, as described above, not only the charged particles present on a location of the supporting element that corresponds to the opening, but also the charged particles present on a location of the supporting element that corresponds to the control electrode are driven toward the opening in response to application of a voltage to the control electrode around the opening. However, if the control electrode extends widely around the opening, or a part of the control electrode widely stretches out, not all of the charged particles present on the location of the supporting element that corresponds to the control electrode are driven toward the opening, but only the charged particles on the location of the supporting element that is affected by the control electrode are driven toward the opening.

In other words, when the control electrode extends widely around the opening, the charged particles on a location of the supporting element that corresponds to the peripheral portion of the control electrode are less likely to be driven toward the opening. When a part of the control electrode widely stretches out, the charged particles on a location of the supporting element that corresponds to the stretch-out portion are less likely to be driven toward the opening.

Accordingly, the opening area is preferably determined such that the percentage of the area of the opening to the area of the portion of the supporting element that is affected by the control electrode so as to drive the charged particles into the opening in response to application of the voltage from the voltage control means to the control electrode is 8% or more.

When the supporting element has a cylindrical shape with the charged particles supported on its peripheral surface, the portion of the supporting element that is affected by the control electrode is present within a distance of 50 $\mu$m or less from a tangent line passing through a point on the supporting element that corresponds to the center of the opening. More specifically, it is now assumed that the supporting element is curved with a prescribed radius of curvature (e.g., a radius of 15 to 20 mm). When the radius of curvature is large, a location beyond the distance of 50 $\mu$m is so far from the opening that it is less likely to be affected by the control electrode. When the radius of curvature is small, an angle between the normal line of a location beyond the distance of 50 $\mu$m and the line connecting that location and the opening is so large that the charged particles are less likely to be driven toward the opening. Accordingly, the distance is preferably 50 $\mu$m or less.

Moreover, the upper limit of the aforementioned percentage is as close to 100% as possible, if the dot density resulting from the charged particles driven onto the image receiving medium through the opening is not concerned. However, in order to improve the dot density while increasing the opening diameter so as to prevent clogging with the charged particles, the width of the control electrode surrounding the opening must be reduced as much as possible. Thus, the upper limit of the percentage is determined from the minimum possible width of the control electrode to be manufactured. More specifically, the minimum possible width of the control electrode produced by, e.g., a current etching method is about 20 $\mu$m. In this case, the upper limit of the percentage is about 52%. A laser processing method can reduce the minimum possible width to about 10 $\mu$m, and therefore the upper limit of the percentage is about 70%. Note that, for example, the minimum electrode width corresponds to the width W of the control electrode 19 shown in FIG. 5.

When a ring-shaped electrode surrounding the opening is used as the control electrode, the percentage of the area of the opening to the area enclosed by the outer periphery of the control electrode may be set to 8% or more, and the upper limit thereof may be set to about 52% or about 72%.

The opening area is preferably 900$\pi$ (unit: $\mu m^2$) or more. This can prevent clogging of the opening with the charged particles. It should be noted that whether or not the opening is likely to be clogged with the charged particles largely depends on the particle size of the charged particles. As the particle size decreases, the lower limit of the opening area is reduced. Note that $\pi$ indicates the ratio of the circumference of a circle to its diameter.

For example, the upper limit of the opening area may be 10,000$\pi$ (unit: $\mu m^2$)

Moreover, particles having a volume-average diameter of 5 to 15 $\mu$m may be used as the charged particles.

According to the present invention, an image forming head provided in front of a supporting element having charged particles for forming an image supported thereon, for controlling driving of the charged particles toward an image receiving medium includes:

an insulating member having a plurality of openings for passing the charged particles therethrough; and a control electrode provided around each opening of the insulating member, and receiving a voltage for controlling passage of the charged particles through the respective opening, wherein a percentage of an area of the opening to a sum of the area of the opening and an area of a portion of the control electrode that extends around the opening and causes the charged particles on the supporting element to be driven toward the opening in response to application of the voltage to the control electrode is 8% or more.

More specifically, as described above, when the control electrode extends widely around the opening, the peripheral portion of the control electrode does not act on substantial image formation (does not serve to drive the charged particles on the supporting element toward the opening). In addition, when a part of the control electrode widely stretches out, the stretch-out portion does not act on substantial image formation.

Accordingly, in the case of forming the image forming head, the area of the opening may be determined based on the sum of the area of the opening and the area of the portion of the control electrode that extends around the opening and causes the charged particles on the supporting element to be driven toward the opening.

In the case of such an image forming head as well, the control electrode preferably has a ring shape surrounding the respective opening. For example, the upper limit of the percentage of the area of the opening may be set to 70%. The area of the opening may be set in the range of 900$\pi$ to 10,000$\pi$ (unit: $\mu m^2$). Particles having a volume-average diameter of 5 to 15 $\mu$m may be used as the charged particles.

As has been described above, according to the present invention, the percentage of the area of the opening to the sum of the area of the extent of the control electrode around the opening and the area of the opening is 8% or more, or the percentage of the area of the opening to the area of the portion of the supporting element that is affected by the control electrode so as to drive the charged particles into the opening is 8% or more, or the percentage of the area of the opening to the sum of the area of the opening and the area of the portion of the control electrode that extends around the opening and causes the charged particles on the supporting element to be driven toward the opening is 8% or more. Therefore, the openings can be prevented from being clogged during image formation without applying to the control electrodes a special voltage for preventing clogging of the openings. This is advantageous to prevention of damages to components of the image forming apparatus, cost reduction, and reliable image formation (dot formation).

BEST MODE FOR CARRYING OUT THE INVENTION

Figure 1:
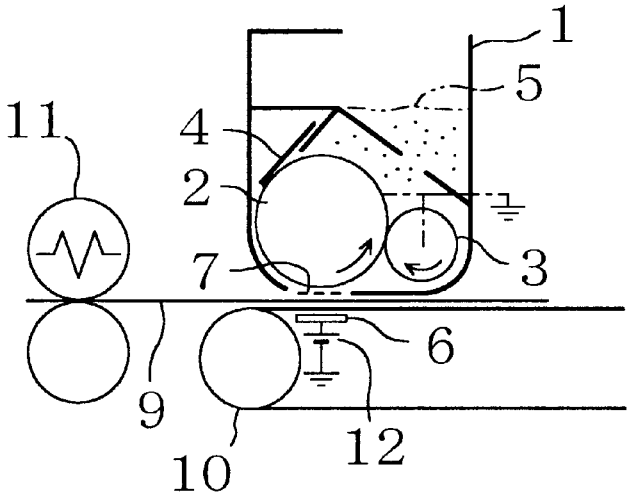
FIG. 1 is a cross-sectional view of an image forming apparatus according to an embodiment of the present invention.

The present invention will now be described in further detail with reference to the accompanying drawings. Main reference numerals in the figures are as follows:

1: housing;

2: developing sleeve (supporting element);

3: supply roller (charging means);

4: regulating blade (charging means);

5: toner (charged particles);

6: opposing electrode;

7: FPC (image forming head);

9: recording paper (image receiving medium);

10: fixing device;

12: transfer power supply (transfer-electrostatic-field forming means);

13: spacer;

16: opening;

17: base plate (insulating member);

19: control electrode; and

22: voltage control means.

The overall structure of an image forming apparatus will now be described.

The image forming apparatus according to an embodiment is schematically shown in FIG. 1. In the figure, reference numeral 1 denotes a housing of a developer charging and supporting means, and the housing 1 contains a developing sleeve 2, a developer supply roller 3, and a developer regulating blade 4.

The developing sleeve 2 is a supporting element for supporting thereon the charged toner (i.e., charged particles for forming an image) 5 as a developer, and rotating at a peripheral velocity of, e.g., 20 to 400 mm/sec so as to carry the charged toner to the position facing an opposing electrode 6 described below. This developing sleeve 2 is formed from a metal such as aluminum and iron or an alloy so as to have a cylindrical shape. The diameter thereof is, e.g., about 16 to 18 mm, and the thickness thereof is, e.g., around 1 mm. Although the developing sleeve 2 is grounded in the example shown in the figure, a DC or AC voltage may alternatively be applied thereto.

The supply roller 3 rotates against the outer peripheral surface of the developing sleeve 2 in the opposite direction to that of the developing sleeve 2, thereby supplying the toner 5 to the developing sleeve 2 while removing excessive toner 5 therefrom. This supply roller 3 is formed from a synthetic rubber such as urethane sponge wrapped around a metal core having a diameter of, e.g., about 6 mm, and has an outer diameter of, e.g., about 12 mm. The supply roller 3 also functions to charge the toner 5 due to the friction contact with the developing sleeve 2. The toner 5 is negatively charged in the present embodiment.

The regulating blade 4, which abuts on the outer peripheral surface of the developing sleeve 2, negatively charges the toner 5 by the friction with the developing sleeve 2 as well as regulates the amount of toner 5 supported on the developing sleeve 4 so that, for example, about one to three toner layers or the toner with a thickness of about 10 to 20 $\mu$m is supported thereon. This regulating blade 4 is formed from a phosphor bronze plate with a thickness of, e.g., around 0.5 mm, one end of the phosphor bronze plate being fixed to a support member of the housing 1, and an elastic member of urethane rubber or the like with a thickness of, e.g., around 1 mm being attached to the other end thereof. The elastic member abuts on the developing sleeve 2.

Accordingly, it can be said that, in the present embodiment, the supply roller 3 and the regulating blade 4 form a charging means for charging the toner 5 in the relation with the developing sleeve 2.

Moreover, in FIG. 1, reference numeral 6 denotes an opposing electrode provided at the position facing the developing sleeve 2. A flexible print circuit (hereinafter, referred to as FPC) 7 as an image forming head is provided between the developing sleeve 2 and the opposing electrode 6, so that a conveying belt 10 conveys recording paper 9 as an image receiving medium between the FPC 7 and the opposing electrode 6. Moreover, a fixing device 11 for fixing the toner 5 attached to the recording paper 9 is provided at the position to which the recording paper 9 is conveyed. A transfer power supply 12 for applying a toner transfer voltage to the opposing electrode 6 is connected thereto. This voltage application causes a transfer electrostatic field for transferring the charged toner 5 toward the opposing electrode 6 to be formed between the developing sleeve 2 and the opposing electrode 6. The transfer power supply 12 forms a transfer-electrostatic-field forming means. This transfer voltage is in the range of, e.g., 400 to 1500 V.

Note that only one developer charging and supporting means is shown in FIG. 1. However, in the case of forming, e.g., a full-color image, similar developer charging and supporting means are respectively formed for four kinds of toners, i.e., yellow, magenta, cyan and black, and are arranged in line in the conveying direction of the recording paper 9.

Figure 2:
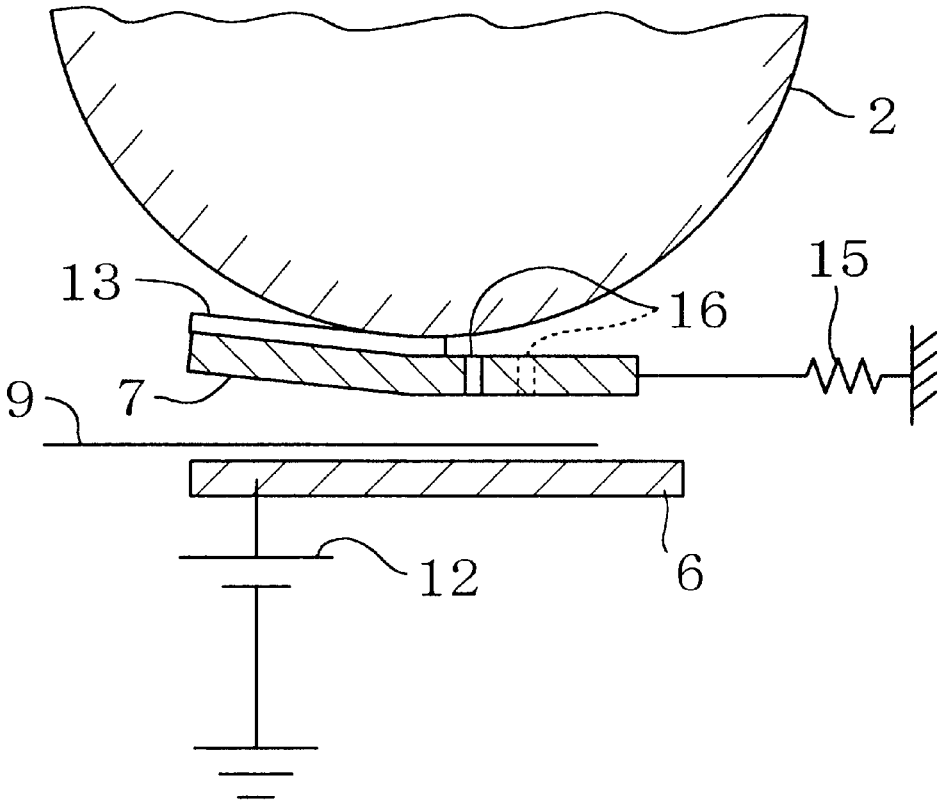
FIG. 2 is an enlarged partial cross-sectional view of the apparatus.

As shown in FIG. 2, a spacer 13 having a thickness of around 10 $\mu$m is inserted between the developing sleeve 2 and the FPC 7 at a position forward of openings 16 of the FPC 7 with respect to the rotating direction of the sleeve. This regulates the spacing between the developing sleeve 2 and the location of the openings 16 of the FPC 7. The distance between the end of the spacer 13 and the opening 16 of the FPC 7 is desirably 1,000 $\mu$m or less, and more desirably, in the range of 100 to 400 $\mu$m. Moreover, the spacing between the location of the openings 16 of the FPC 7 and the opposing electrode 6 is desirably in the range of 50 to 500 $\mu$m, and more desirably, in the range of 50 to 300 $\mu$m.

Moreover, one side of the FPC 7 is fixed to the housing 1, and the opposite side thereof is coupled with tension to the housing 1 through a tension spring 15. This tension presses the FPC 7 against the developing sleeve 2 with a pressure of 10 N or less with the spacer 13 interposed therebetween.

The structure of the FPC 7 will now be described.

Figure 3:
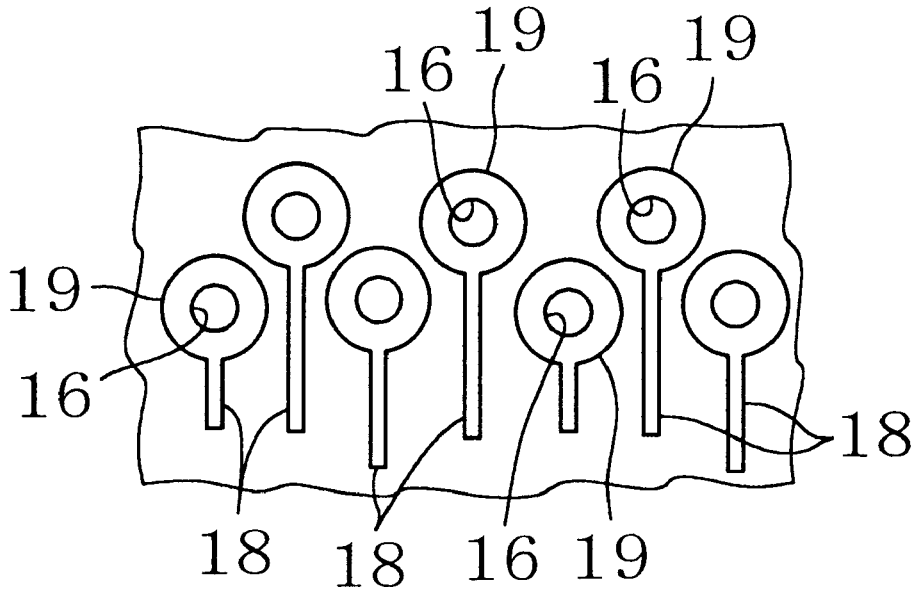
FIG. 3 is a partial plan view of an FPC of the apparatus.
Figure 4:
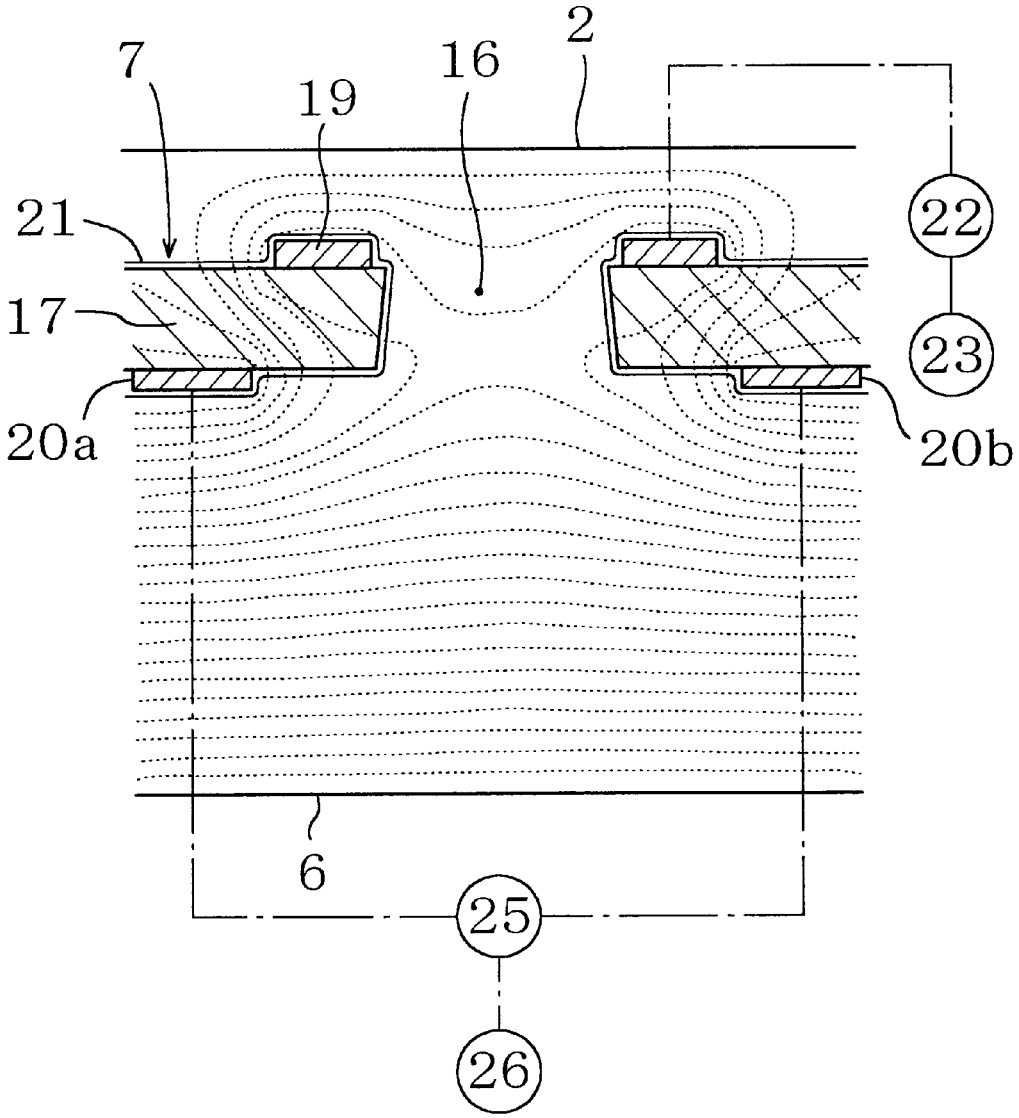
FIG. 4 is a cross-sectional view showing equipotential lines between a developing sleeve and an opposing electrode of the apparatus upon application of a driving voltage.

As shown in FIGS. 3 and 4, the FPC 7 includes a base plate 17 having a plurality of openings 16 arranged in the longitudinal direction of the developing sleeve 2, a control electrode 19 provided for every opening 16 on the surface of the base plate 17 that faces the developing sleeve 2, a pair of deflecting electrodes 20*a*, 20*b* provided for every opening 16 on the opposite surface of the base plate 17 (the surface facing the opposing electrode 6), and a cover coat 21 formed from en electrically insulating polymer so as to cover the control electrodes 19 and the deflecting electrodes 20*a*, 20*b* from the respective inner surfaces of the openings 16 of the base plate 17. Each control electrode 19 is connected to a power supply 23 through a voltage control means 22.

The base plate 17 is formed from, e.g., polyimide, and has an electrically insulating property. The thickness thereof is in the range of 25 to 40 $\mu$m. The plurality of openings 16 are intended to pass the toner 5 therethrough, and in the present embodiment, are arranged in two lines in the longitudinal direction of the developing sleeve 2 in such a positional relation that the openings 16, 16 in the respective lines are displaced by half pitch in the line direction (staggered relation). Note that the plurality of openings 16 may be arranged in a single line, but such a two-line, staggered arrangement improves the arrangement density (dot density).

The control electrodes 19 are intended to electrostatically open and close the respective openings 16 in response to selective application of an appropriate voltage described below from the voltage control means 22. In other words, the control electrodes 19 are intended to expose between the developing sleeve 2 and the opposing electrode 6 a transfer electrostatic field extending through the openings 16 so that the charged toner 5 is separated from the developing sleeve 2 and driven toward the opposing electrode 6 through the openings 16, and to limit such exposure. In the example of FIG. 3, the control electrodes 19 each have a ring shape surrounding the respective openings 16. The control electrodes 19 have a thickness of 5 to 20 μm, and for example, around 10 μm. Moreover, lead wires 18 extend from the respective control electrodes 19 in the direction perpendicular to the arrangement direction of the openings 16.

Figure 6:
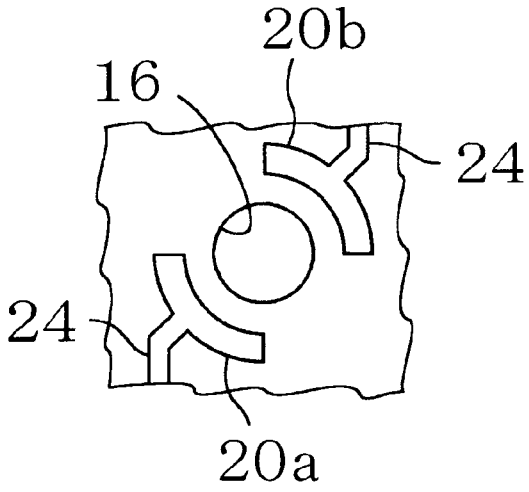
FIG. 6 is a partial bottom view of the FPC illustrating arrangement of deflecting electrodes of the apparatus.

The deflecting electrodes 20*a*, 20*b*, which are intended to deflect the charged toner 5 passing through the respective openings 16, are provided so as to face each other obliquely with respect to the conveying direction of the recording paper 9 (the direction perpendicular to that of the opening lines) as shown in FIG. 6, and are each connected to a deflecting power supply 26 through respective lead wires 24, 24 and a deflecting-voltage control means 25. The deflecting electrodes 20*a*, 20*b* have a thickness of 5 to 20 μm, and for example, around 10 μm. The deflecting manner will be described later.

The cover coat 21 can be formed from coating of an insulating polymer or lamination of a thin insulating polymer film, and the thickness thereof is, e.g., in the range of 5 to 25 μm. Note that, preferably, the total thickness of the FPC 7 including the base plate 17, control electrode 19, deflecting electrode 20 and cover coat 21 is, e.g., in the range of about 80 to 200 μm.

The shape and area of the opening 16 and control electrode 19 will now be described.

The opening 16 preferably has a circular shape with a diameter of 50 to 200 μm, and more preferably, with a diameter of 60 μm or more. In this case, the opening area Aa is $30\times30\times\pi$ ($\mu m^2$) or more. The upper limit of the opening area Aa is herein, e.g., 10,000 π ($\mu m^2$). It should be noted that an elliptical or polygonal shape having an equivalent opening area thereto is also possible. In the case of the elliptical opening, the ratio of its major axis to minor axis is preferably in the range of 1 to 2. In the case of the polygonal opening, the number of angles thereof is preferably four or more, and the ratio of its major axis to minor axis is preferably in the range of 1 to 2.

Figure 5:
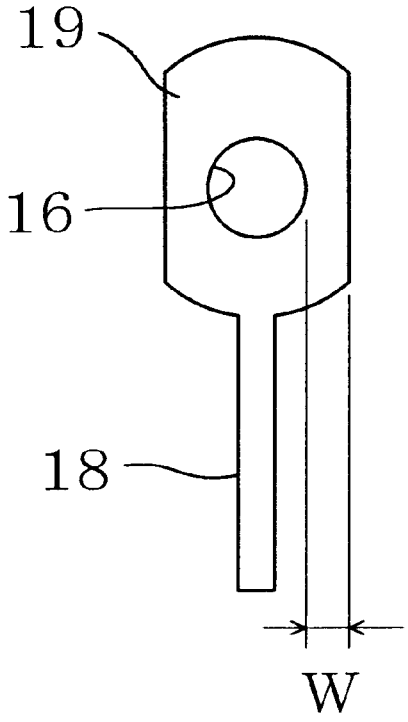
FIG. 5 is a plan view showing an exemplary shape of a control electrode of the apparatus.

The control electrode 19 may have a circular, elliptical or polygonal ring shape surrounding the opening 16 (a ring shape corresponding to the shape of the circumference of each opening). It should be noted that the ring shape may be an imperfect ring shape. FIG. 5 shows another example of the shape of the control electrode 19. In the example of the figure, the control electrode 19 has such a shape that both sides of the circular ring (the front and rear sides in the arrangement direction of the openings 16) are cut straight in the direction of the lead wire 18. In other words, the control electrode 19 has a narrow width on both sides thereof. This is advantageous in densely arranging a multiplicity of openings 16 (or control electrodes 19) while ensuring such a distance between adjacent control electrodes that allows for insulation, whereby the dot density is improved.

Provided that the area of the opening 16 is Aa, the area Ac of the extent of the control electrode 19 around the opening is preferably set so that a percentage of Aa/(Aa+Ac) is 8% or more. A standard upper limit of the percentage may be about 70%. The control electrode 19 is desirably provided along the opening 16 (so that the circumference of the opening and the internal circumference of the control electrode are hardly separated from each other). In the case where the ring-shaped control electrode 19 is employed, a percentage of the area Aa of the opening 16 to the area A enclosed by the outer periphery of the control electrode 19 need only be set to 8% or more. A standard upper limit of the percentage may be about 70%. In the case where there is substantially no such separation, Aa/(Aa+Ac)=Aa/A. In the case where the control electrode 19 does not have a ring shape, the percentage of Aa/(Aa+Ac) need only be set to 8% or more. In the case where there is such separation, the percentage of Aa/A need only be set to 8% or more.

In the case where there is only a small extent of the control electrode 19 around the opening 16, the area A of the extent of the control electrode 19 around the opening 16 corresponds to the range of the developing sleeve 2 that is affected by the control electrode 19 so as to drive the charged toner 5 into the opening 16. However, if the extent is large, the area A thereof does not always correspond to that range. For example, this applies to the case where the control electrode 19 extends widely in the direction perpendicular to the arrangement direction of the openings 16 (the longitudinal direction of the developing sleeve 2), as shown in,FIG. 7.

In such a case, the size of the opening 16 need only be determined based on the area of the control electrode 19 that effectively causes the charged toner 5 on the developing sleeve 2 to be driven toward the opening 16 in response to application of a control voltage to the control electrode 19.

Figure 7:
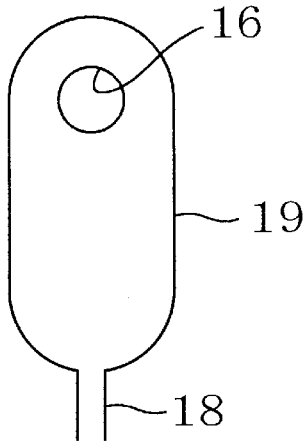
FIG. 7 is a plan view showing another exemplary shape of the control electrode of the apparatus.
Figure 8:
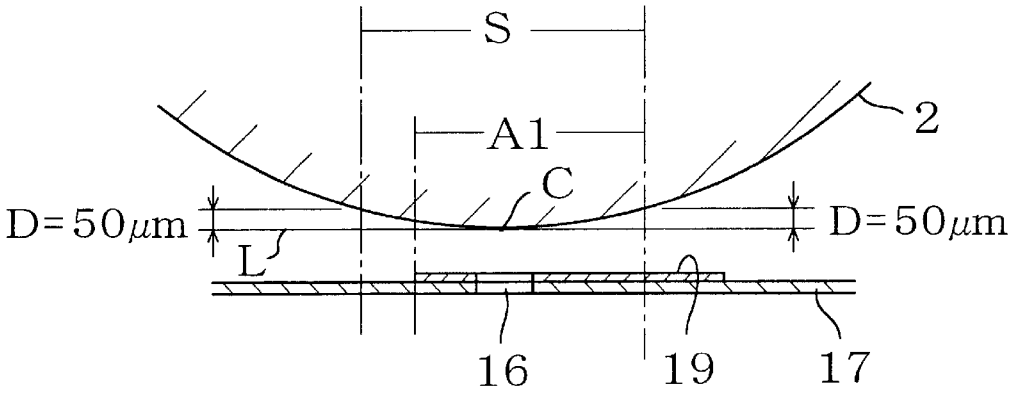
FIG. 8 is an illustration of a range of the control electrode of FIG. 7 that is effective in driving charged toner, and a range of the developing sleeve that is affected by the control electrode.

More specifically, in the case of the control electrode 19 shown in FIG. 7, it is only the portion around the opening 16 as shown in FIG. 8 (the portion A1 in the figure) that causes the charged toner on the developing sleeve 2 to be driven toward the opening 16 in response to application of the control voltage. In other words, the range S that is possibly affected by the control electrode 19 so as to drive the charged toner on the developing sleeve 2 toward the opening 16 corresponds to a portion present within a distance D of 50 μm or less from a tangent line L passing through the point C corresponding to the center of the opening 16.

Accordingly, the percentage of Aa/(Aa+Ac) need only be set to 8% or more as in the case described above, where Ac is herein an effective area of the portion A1 located within the range S and extending around the opening out of the extent of the control electrode 19.

Note that, in the case where the control electrode 19 partially or wholly extends widely around the opening 16, the range of the developing sleeve 2 from which the charged toner 5 is actually driven toward the opening 16, i.e., the area of the driving trace on the developing sleeve 2, does not match the sum of the effective area Ac of the control electrode 19 and the opening area Aa. In such a case, it is only necessary that the area of the actual driving trace (the area of the developing sleeve 2 that is affected by the control electrode 19 so as to drive the charged toner 5 toward the opening 16) is measured and a percentage of the opening area Aa to the area of the driving trace is set to 8% or more.

Exposure control of a transfer electrostatic field by the control electrode 19 will now be described.

Figure 9:
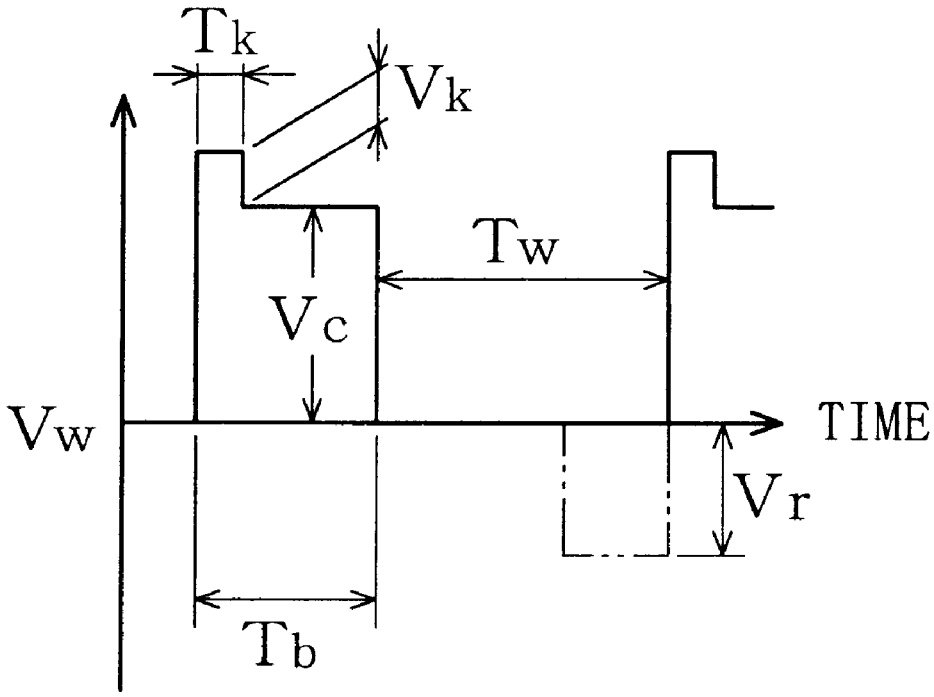
FIG. 9 is a time chart of a voltage applied to the control electrode of the apparatus.

When the image forming apparatus is used, a transfer voltage Vbe for forming a transfer electrostatic field is applied to the opposing electrode 6. FIG. 9 is a time chart of a voltage applied from the voltage control means 22 to the control electrode 19 in response to an external image signal applied to the voltage control means 22 of the control electrode 19.

A ground potential Vw has been applied to the control electrode 19. When the image signal is input, a pulsed control voltage Vc is applied to the control electrode 19 for a time period Tb, and simultaneously with the rise of the control voltage Vc, a pulsed superimposed voltage Vk is applied to the control electrode 19 for a time period Tk. Accordingly, Vw+Vc (or Vw+Vc+Vk) serves as a driving voltage for exposing the transfer electrostatic field to the opening 16 so as to drive the charged toner 5 from the developing sleeve 2 onto the recording paper 9 through the opening 16.

More specifically, the ground potential Vw is a voltage of the same polarity as that of the charged toner 5, and is desirably in the range of, e.g., −150 to 0 V, and more desirably, around −50 V. The control voltage Vc is a voltage of the opposite polarity to that of the charged toner 5, and is desirably in the range of, e.g., 100 to 400 V, and more desirably, around 320 V. The superimposed voltage Vk is a voltage of the opposite polarity to that of the charged toner 5, and is desirably in the range of, e.g., 20 to 150 V, and more desirably, around 50 V. The time period Tb may be, e.g., 80 μs, and the time period Tk may be, e.g., 25 μs. The superimposed voltage Vk is applied in order to facilitate separation of the charged toner 5 from the developing sleeve 2.

Accordingly, by applying an intermediate voltage of the voltage difference (the transfer voltage Vbe) between the developing sleeve 2 and the opposing electrode 6 to the control electrode 19 as a driving voltage, a potential gradient through the opening 16, i.e., a transfer electrostatic field, is formed (exposed) between the developing sleeve 2 and the opposing electrode 6, as shown by the equipotential lines in FIG. 4, so that the charged toner 5 is separated from the developing sleeve 2 onto the recording paper 9 through the opening 16.

During application of this driving voltage, the charged toner 5 present in the space right above the opening 16 (the space between the location of the developing sleeve 2 corresponding to the opening 16 and the location of the opening 16 of the FPC 7) is discharged through the opening 16, whereby the toner concentration in the space is reduced. However, as can be seen from the equipotential lines in FIG. 4, an electrostatic field surrounding the control electrode 19 is produced with its potential progressively increased toward the control electrode 19. Accordingly, with the reduction in toner concentration right above the opening 16, the electrostatic field surrounding the control electrode 19 moves the charged toner 5 from a position around the space right above the opening 16 toward the opening 16, so that the charged toner 5 adheres to the control electrode 19 and its periphery. In other words, not only the charged toner 5 present on the location of the developing sleeve 2 that corresponds to the opening 16, but also the charged toner 5 present on the location of the developing sleeve 2 that corresponds to the control electrode 19 pass through the opening 16.

After the time period Tb, only the ground potential Vw is applied to the control electrode 19 for a time period Tw, i.e., until the following pulse of the driving control voltage Vc is applied. This ground potential Vw may be the same potential as that of the developing sleeve 2, i.e., 0 V, or a positive potential (but lower than Vc). However, if the ground potential Vw is of the same polarity as that of the charged toner 5, i.e., a negative potential, this potential is lower than 0 V, i.e., the ground potential of the developing sleeve 2. Therefore, a limiting electrostatic field of the opposite direction to that of the transfer electrostatic field is produced between the developing sleeve 2 and the control electrode 19, whereby additional charged toner 5 can be reliably prevented from being driven from the developing sleeve 2 toward the opening 16. It should be noted that this limiting electrostatic field has a relatively gentle potential gradient. Therefore, the charged toner 5 that has already been driven toward the opening 16 at the time the limiting voltage (ground potential Vw) is applied continues to be driven and thus reaches the recording paper 9 through the opening 16. This prevents the dot concentration from becoming lower than intended.

It is also possible to apply only the ground potential Vw to the control electrode 19 in the first half of the time period Tw and apply a return voltage Vr of the same polarity as that of the charged toner 5 to the control electrode 19 in the latter half thereof as shown by the chain line in FIG. 9. The return voltage Vr is, e.g., in the range of −250 to −50 V. In this case, the ground potential VW and the return voltage Vr are applied to the control electrode 19. As a result, a limiting electrostatic field having the opposite direction to that of the transfer electrostatic field and also having a relatively steep potential gradient can be formed between the developing sleeve 2 and the control electrode 19, whereby the charged toner 5 remaining around the control electrode 19 without passing through the opening 16 upon previous application of the driving voltage can be reliably returned to the developing sleeve 2.

Note that the aforementioned desirable value or range of each voltage to be applied to the control electrode 19 applies to the case where the ground potential of the developing sleeve 2 is 0 V. In the case where the potential of the developing sleeve 2 is set to a value other than 0 V, a voltage is applied to the control electrode 19 so that the voltage difference corresponding to each voltage value or range described above is obtained based on the potential of the developing sleeve 2.

The charged toner 5 has a negative polarity. If the charged toner 5 of a positive polarity is used, respective voltages of the developing sleeve 2, opposing electrode 6 and control electrode 19 are set so that an electrostatic field of the opposite direction to that in the above embodiment is formed with the aforementioned voltage difference.

The influence of the respective areas of the opening 16 and the control electrode 19 on clogging of the opening 16 will now be described.

Black printing (dot formation) was conducted on the whole sheet of A4-size recording paper under the following conditions in order to test for clogging of the openings 16. It should be noted that the openings 16 were not cleaned during the testing.

Thickness of the spacer 13: 10 μm (made of stainless)
Spacing between the opposing electrode 6 and the FPC 7: 280 μm Conveyance rate of the recording paper 9: 65 mm/s Peripheral velocity of the developing sleeve 2: 130 mm/s Potential of the developing sleeve 2: 0 V Potential Vbe of the opposing electrode 6: 1,000 V Potentials of control electrode 19
- Vw: −50 V
- Vc: 320 V (Time period Tb: 80 μs)
- Vk: 50 V (Time period Tk: 25 μs)
- Vr: not applied Exposure-limitation time period Tw: 137 μs Shape of the opening 16: circular Area of the opening 16: various Shape of the control electrode 19: shown in FIG. 5

Area of the control electrode 19: various

Types of the toner 5: a toner prepared by a grinding method and a toner prepared by a polymerization method The aforementioned ground toner and polymerized toner are both mainly comprised of negatively charged right sign toner, and contain several percents of positively charged right sign toner. Measurement values are shown in Table 1. Note that two kinds of charging amounts are shown. The measurement was conducted at a temperature of 26.3° C. and relative humidity of 50%.

Note that, instead of the aforementioned ground toner and polymerized toner, the same testing was conducted for toners 3 to 6 of Table 2 prepared by the polymerization method, and the same result was obtained.

TABLE 1

| | Right sign toner | | | | Proportion of wrong sign toner | | Charging amount (q/d) | | Charging amount (q/m) | |
|---|---|---|---|---|---|---|---|---|---|---|
| Type | Number-average (μm) | Standard deviation | Volume average (μm) | Standard deviation | Number-average (%) | Volume average (%) | Median | Standard deviation | Median | Standard deviation |
| 1 | 5.3 | 1.316 | 7.8 | 2.466 | 6.8 | 4.25 | −1.72 | 1.495 | −15.63 | 21.566 |
| 2 | 5.2 | 1.215 | 5.7 | 1.195 | 4.67 | 4.27 | −1.83 | 1.473 | −15.64 | 17.594 |

Figure 10:
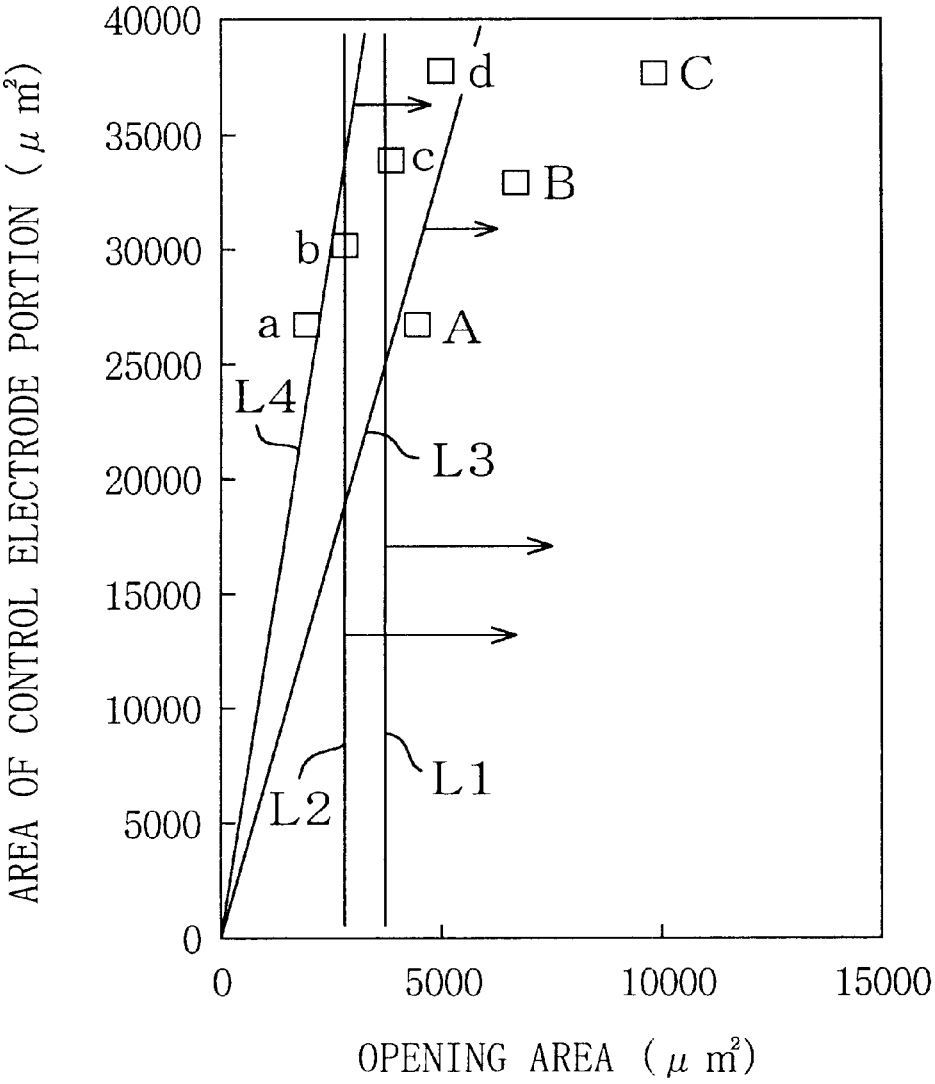
FIG. 10 is a graph showing the test result of clogging of openings.
Figure 11:
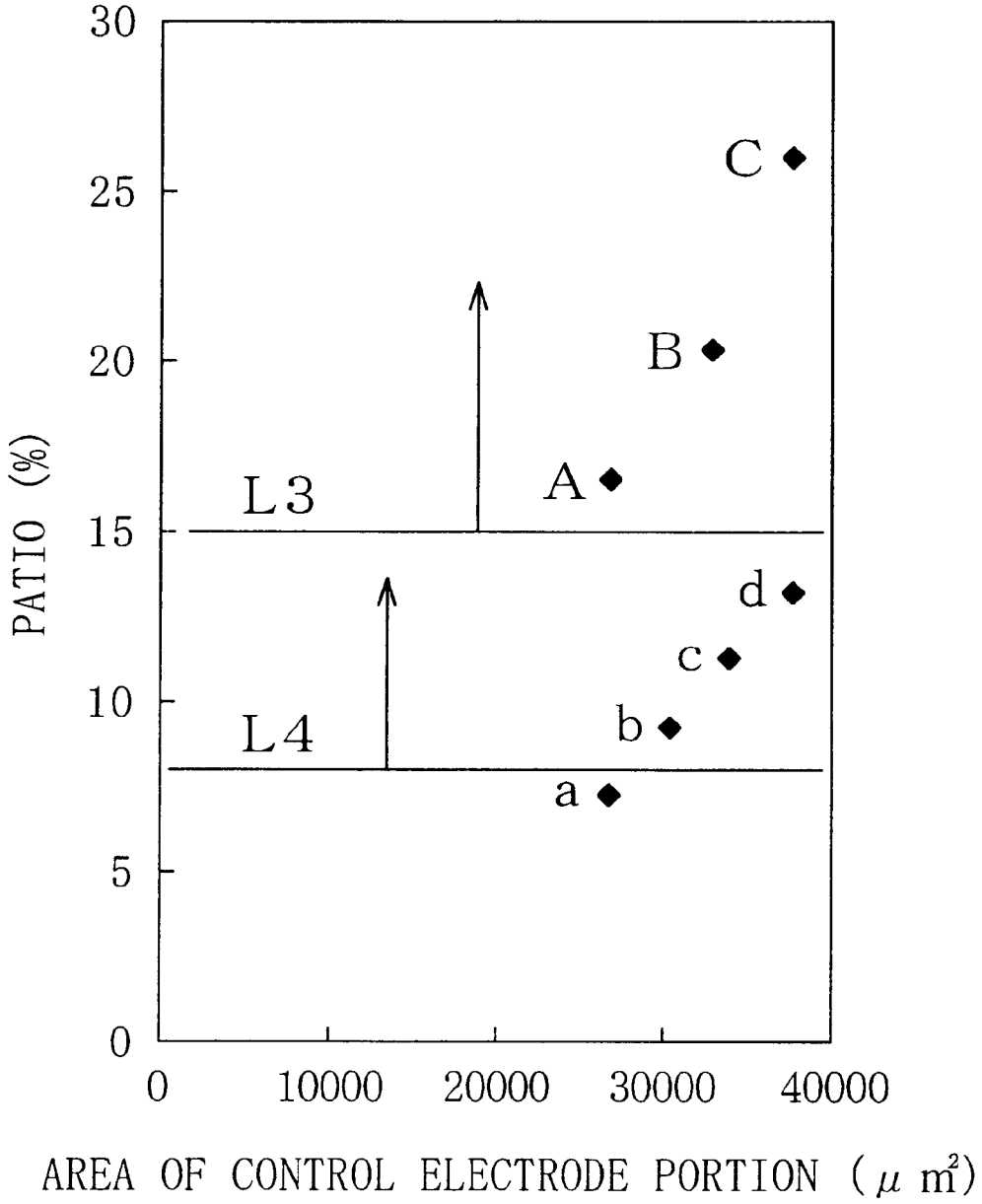
FIG. 11 is another graph showing the test result.

Remarks: Type 1 is a toner prepared by a grinding method, and type 2 is a toner prepared by a polymerization method The result is shown in FIGS. 10 and 11. In the figures, plots A, B, C are examples using the ground toner, and plots a, b, c, d are examples using the polymerized toner. In FIG. 10, the abscissa indicates the opening area, and the ordinate indicates the area of a control electrode portion (i.e., the sum of the opening area and the control electrode area). In the plots A, B, C on the right of the line L1 (the diameter of the circular opening: 34 μm) and the plots b, c, d on the right of the line L2 (the diameter of the circular opening: 30 μm) in the figure, the openings 16 were not clogged with the charged toner 5 even in the fifteenth sheet of recording paper. In contrast, in the plot a, the openings 16 were clogged within twenty sheets. In the figure, L3 is such a line that a percentage of the opening area to the area of the control electrode portion is 15%, and L4 indicates such a line that the aforementioned percentage is 8%. The plots A, B, C exhibiting no clogging of the openings are located on the right of the line L3 (on a higher-percentage side), and the plots b, c, d exhibiting no clogging of the openings are also located on the right of the line L4 (on a higher-percentage side).

In FIG. 11, the abscissa indicates the area of the control electrode portion, i.e., the sum of the opening area and the control electrode area, and the ordinate indicates a percentage of the opening area to the sum. The plots A, B, C exhibiting no clogging of the openings with the ground toner are located above the line L3 corresponding to the percentage of 15%, and the plots b, c, d exhibiting no clogging of the openings with the polymerized toner are located above the line L4 corresponding to the percentage of 8%.

It can be said from the result that, for the polymerized toner, using a circular opening having a diameter of 30 μm or an opening having an equivalent opening area and setting the aforementioned percentage to 8% or more are advantageous in avoiding clogging of the openings, and for the ground toner, using a circular opening having a diameter of 34 μm or an opening having an equivalent opening area and setting the aforementioned percentage to 15% or more are advantageous in avoiding clogging of the openings. It can be considered that the reason why the polymerized toner is less likely to cause clogging of the openings 16 than the ground toner even with a smaller opening diameter and a smaller percentage is that the polymerized toner has a shape close to a sphere.

As the particle size of the toner is reduced, the lower limit of the opening diameter is also reduced. However, a volume-average diameter of 5 to 15 μm is preferable as the toner particle size (charged particle size).

TABLE 2

| | Right sign toner | | | | Proportion of wrong sign toner | |
|---|---|---|---|---|---|---|
| Type | Number-average (μm) | Standard deviation | Volume average (μm) | Standard deviation | Number-average (%) | Volume average (%) |
| 3 | 6.1 | 1.193 | 6.7 | 1.188 | 2.6 | 2.16 |
| 4 | 5 | 1.269 | 5.7 | 1.256 | 3.53 | 3.02 |
| 5 | 4.8 | 1.18 | 5.2 | 1.172 | 4.37 | 3.76 |
| 6 | 5.4 | 1.242 | 5.9 | 1.192 | 8.07 | 6.55 |

In the present embodiment, a mono-component toner pressed against the developing sleeve 2 and charged by layer regulation is employed as the toner 5. However, a two-component toner charged by stirring with carriers may alternatively be employed.

Deflection of the charged toner by the deflecting electrodes will now be described.

Figure 12:
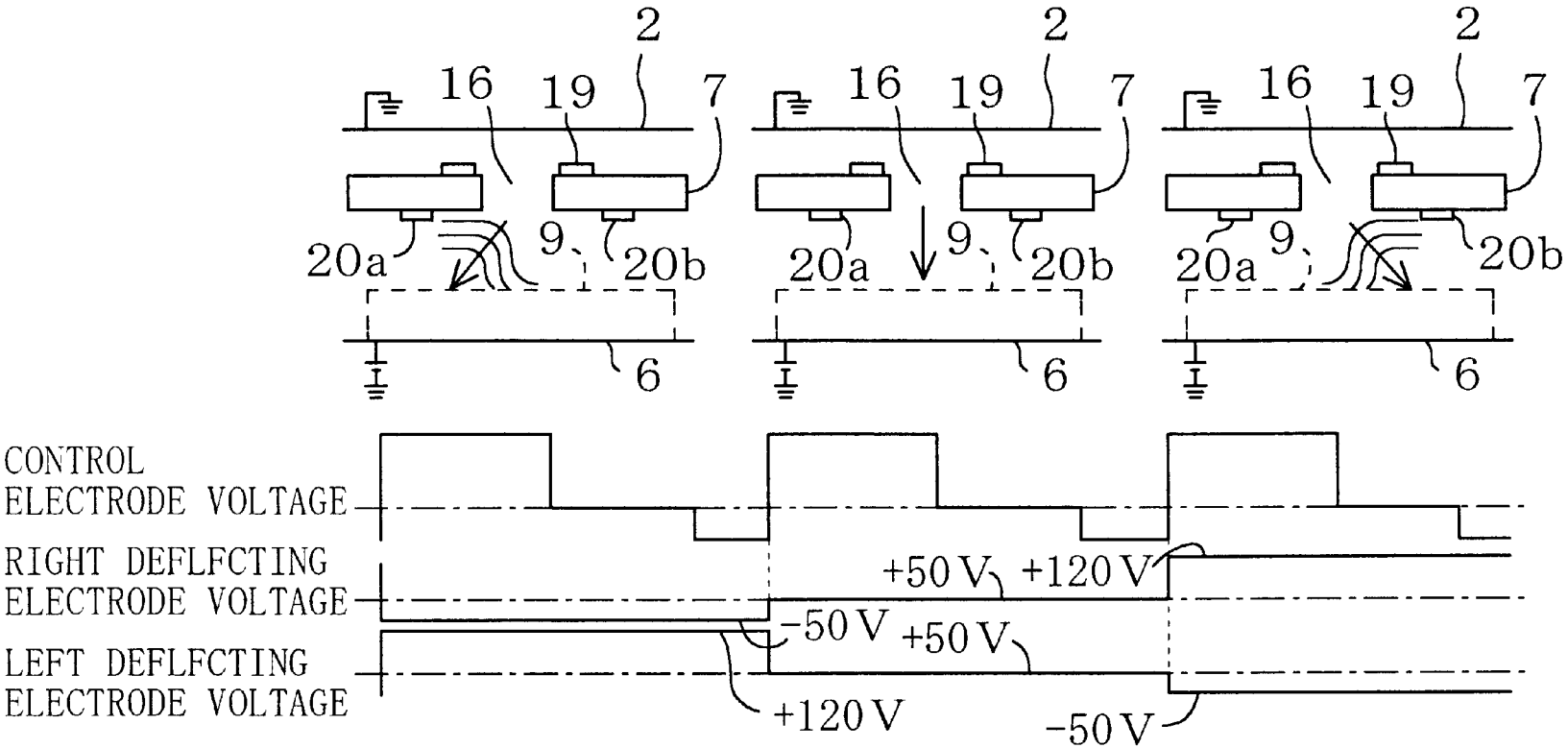
FIG. 12 is an illustration showing an example of voltage control of the deflecting electrodes of the apparatus.

The central portion of FIG. 12 shows the case where the same voltage is applied to both deflecting electrodes 20*a*, 20*b*. The charged toner 5 passes straight through the opening 16 as shown by the arrow, and reaches the recording paper 9 at the position corresponding to the opening position (no deflection). In contrast, the left portion of the figure shows the case where a relatively higher voltage is applied to the deflecting electrode 20*a* located on the left side of the opening 16 with respect to the convey direction of the recording paper 9 than to the deflecting electrode 20*b* located on the right side thereof. The negatively charged toner 5 is deflected to the left by an electrostatic field produced between the electrodes 20*a*, 20*b*. The right portion of the figure shows the case where a relatively higher voltage is applied to the right deflecting electrode 20*b* than to the left deflecting electrode 20*a*. In this case, an electrostatic field of the opposite direction to that of the aforementioned electrostatic field is produced between the deflecting electrodes 20*a*, 20*b*, so that the negatively charged toner 5 is deflected to the right.

Figure 13:
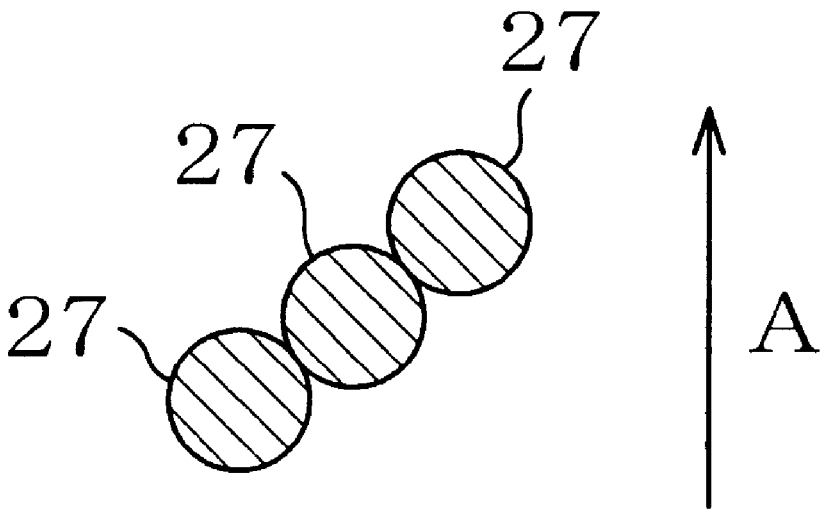
FIG. 13 is a plan view showing dot arrangement produced by using the deflecting electrodes of the apparatus.

It should be noted that, as described above, the deflecting electrodes 20*a*, 20*b* face each other obliquely with respect to the conveying direction of the recording paper 9. Therefore, when the recording paper 9 is stopped, three dots 27 aligned obliquely with respect to the moving direction of the recording paper 9 are formed due to the aforementioned three manners, i.e., no deflection, left deflection and right deflection, as shown in FIG. 13. In this case, the conveying speed of the recording paper 9 is determined so that the recording paper 9 is conveyed by the displacement amount (distance) between adjacent dots 27, 27 in a cycle (time period) of forming the dot 27. Thus, these three dots 27 can be aligned in the direction perpendicular to the conveying direction A of the recording paper 9. This enables the three dots 27 to be covered by a single opening 16, allowing for improved dot density.

The aforementioned deflection is conducted by controlling the voltage applied to the left and right deflecting electrodes 20*a*, 20*b* by the voltage control means 25. For example, for straight movement, a voltage of 50 V is applied to both electrodes 20*a*, 20*b*; for left deflection, voltages of 120 V and −50 V are respectively applied to the left and right electrodes 20*a* and 20*b*; and for right deflection, voltages of −50 V and −120 V are respectively applied to the left and right electrodes 20*a* and 20*b*.

INDUSTRIAL APPLICABILITY

As has been described above, an image forming apparatus and an image forming head according to the present invention are useful as a printer for computers, facsimiles, copying machines, and the like.

What is claimed is:

1. An image forming apparatus for forming an image by attaching charged particles (5) to an image receiving medium (9), comprising:

a charging means (3, 4) for applying charges to particles for forming an image;

a supporting element (2) for supporting and carrying the charged particles (5) having the charges applied thereto by the charging means (3, 4);

an opposing electrode (6) provided at a position facing a position on the supporting element (2) to which the charged particles are carried;

an insulating member (17) provided between the supporting element (2) and the opposing electrode (6) and having a plurality of openings (16) for passing the charged particles (5) therethrough;

a control electrode (19) provided around each opening (16) of the insulating member (17);

a transfer-electrostatic-field forming means (12) for providing a potential difference so as to form between the supporting element (2) and the opposing electrode (6) a transfer electrostatic field for transferring the charged particles (5) on the supporting element (2) toward the opposing electrode (6); and a voltage control means (22) for applying a voltage to the control electrodes (19) around the respective openings (16) according to an image signal so as to control passage of the charged particles (5) through the respective openings (16) that is caused by the transfer electrostatic field, wherein a percentage of an area of the opening (16) to a sum of an area of an extent of the control electrode (19) around the opening (16) and the area of the opening (16) is 8% or more.

2. An image forming apparatus for forming an image by attaching charged particles (5) to an image receiving medium (9), comprising:

a charging means (3, 4) for applying charges to particles for forming an image;

a supporting element (2) for supporting and carrying the charged particles (5) having the charges applied thereto by the charging means (3, 4);

an opposing electrode (6) provided at a position facing a position on the supporting element (2) to which the charged particles are carried;

an insulating member (17) provided between the supporting element (2) and the opposing electrode (6) and having a plurality of openings (16) for passing the charged particles (5) therethrough;

a control electrode (19) provided around each opening (16) of the insulating member (17);

a transfer-electrostatic-field forming means (12) for providing a potential difference so as to form between the supporting element (2) and the opposing electrode (6) a transfer electrostatic field for transferring the charged particles (5) on the supporting element (2) toward the opposing electrode (6); and a voltage control means (22) for applying a voltage to the control electrodes (19) around the respective openings (16) according to an image signal so as to control passage of the charged particles (5) through the respective openings (16) that is caused by the transfer electrostatic field, wherein a percentage of an area of the opening (16) to an area of a portion of the supporting element (2) that is affected by the control electrode (19) so as to drive the charged particles (5) into the opening (16) in response to application of the voltage from the voltage control means (22) to the control electrode (19) is 8% or more.

3. The image forming apparatus according to claim 1, wherein the supporting element (2) has a cylindrical shape with the charged particles (5) supported on its peripheral surface, and the portion of the supporting element (2) that is affected by the control electrode (19) is present within a distance of 50 $\mu$m or less from a tangent line (L) passing through a point on the supporting element (2) that corresponds to a center of the opening (16).

4. The image forming apparatus according to claim 1 or 2, wherein the control electrode (19) has a ring shape surrounding the respective opening (16).

5. The image forming apparatus according to claim 1 or 2, wherein the percentage of the area of the opening (16) is 70% or less.

6. The image forming apparatus according to claim 1 or 2, wherein the area of the opening (16) is 900$\pi$ (unit: $\mu m^2$) or more.

7. The image forming apparatus according to claim 6, wherein the charged particles (5) have a volume-average diameter of 5 to 15 $\mu$m.

8. The image forming apparatus according to claim 1 or 2, wherein the area of the opening (16) is 10,000$\pi$ (unit: $\mu m^2$) or less.

9. An image forming head (7) provided in front of a supporting element (2) having charged particles (5) for forming an image supported thereon, for controlling driving of the charged particles (5) toward an image receiving medium (9), comprising:

an insulating member (17) having a plurality of openings (16) for passing the charged particles (5) therethrough; and a control electrode (19) provided around each opening (16) of the insulating member (17), and receiving a voltage for controlling passage of the charged particles (5) through the respective opening (16), wherein a percentage of an area of the opening (16) to a sum of the area of the opening (16) and an area of a portion of the control electrode (19) that extends around the opening (16) and causes the charged particles (5) on the supporting element (2) to be driven toward the opening (16) in response to application of the voltage to the control electrode (19) is 8% or more.

10. The image forming head according to claim 9, wherein the control electrode (19) has a ring shape surrounding the respective opening (16).

11. The image forming head according to claim 9, wherein the percentage of the area of the opening (16) is 70% or less.

12. The image forming head according to claim 9, wherein the area of the opening (16) is 900π (unit: $\mu m^2$) or more.

13. The image forming head according to claim 12, wherein the charged particles (5) have a volume-average diameter of 5 to 15 $\mu$m.

14. The image forming head according to claim 9, wherein the area of the opening (16) is 10,000π (unit: $\mu m^2$) or less.

* * * * *

UNITED STATES PATENT AND TRADEMARK OFFICE

CERTIFICATE OF CORRECTION

PATENT NO. : 6,499,830 B1 
DATED : December 31, 2002
INVENTOR(S) : Akira Kumon et al.

It is certified that error appears in the above-identified patent and that said Letters Patent is hereby corrected as shown below:

Title page,
Item [73], Assignee, "Kadoma" should be -- Osaka --.
Item [57], ABSTRACT,
Lines 4 and 5, "electrode. (6)." should be -- electrode (6). --.

Signed and Sealed this

Sixteenth Day of September, 2003

JAMES E. ROGAN
*Director of the United States Patent and Trademark Office*